US008574022B2

(12) United States Patent
Grisolia et al.

(10) Patent No.: US 8,574,022 B2
(45) Date of Patent: Nov. 5, 2013

(54) TOY VEHICLE

(75) Inventors: Nick Grisolia, Lake Geneva, WI (US); Peter Greenley, Lake Geneva, WI (US); Gerry Dean Cody, Jr., Los Angeles, CA (US); Chan Hok Yat, TST East (HK)

(73) Assignee: G2 Inventions, LLC, Lake Geneva, WI (US)

( * ) Notice: Subject to any disclaimer, the term of this patent is extended or adjusted under 35 U.S.C. 154(b) by 188 days.

(21) Appl. No.: 13/247,204

(22) Filed: Sep. 28, 2011

(65) Prior Publication Data

US 2012/0094574 A1 Apr. 19, 2012

Related U.S. Application Data

(60) Provisional application No. 61/392,747, filed on Oct. 13, 2010.

(51) Int. Cl.
*A63H 17/00* (2006.01)

(52) U.S. Cl.
USPC ..... 446/437

(58) Field of Classification Search
USPC ..... 446/437, 454
See application file for complete search history.

(56) References Cited

U.S. PATENT DOCUMENTS

| | | | | |
|---|---|---|---|---|
| 5,338,247 | A * | 8/1994 | Miles | 446/456 |
| 5,549,501 | A * | 8/1996 | Jow | 446/460 |
| 6,840,839 | B2 * | 1/2005 | Rehkemper et al. | 446/454 |
| 7,094,125 | B2 * | 8/2006 | Kaneko et al. | 446/466 |
| 7,429,204 | B2 * | 9/2008 | Reuter et al. | 446/94 |
| 2002/0160688 | A1 * | 10/2002 | Rehkemper et al. | 446/454 |

* cited by examiner

*Primary Examiner* — Michael Dennis
(74) *Attorney, Agent, or Firm* — Adam K. Sacharoff

(57) ABSTRACT

In one embodiment there is provided a toy car that includes four wheels which have a weight that is at least 40%, 50%, 70% or 80% of the total weight of the car. In another aspect each wheel has a center point, with a combined weight such that a horizontally planar center of gravity defined by the car and measured from a lowest point on an outer edge of the four wheels towards a center of the body is positioned substantially about the center point of the four wheels. In either embodiment, the body may include an upper outer portion and the upper outer portion includes a finger detent.

16 Claims, 20 Drawing Sheets

TOY VEHICLE

CROSS REFERENCE TO RELATED APPLICATION

The present invention claims priority to U.S. Provisional Application 61/392,747 filed Oct. 13, 2010.

BACKGROUND OF THE INVENTION

The background of the invention relates to small toy cars. Toy cars have been developed for many years, most notably cars under the trademark Hot Wheels have been around for over 40 years. These and similar die cast toy cars are based on being approximately 1:64 to 1:43 scale design. The free form play that these toy cars provide are a staple in today's society, and while it is difficult to find fault with any aspect of these cars has been highly noticed that these cars do have limitations. For example purposes only, virtually all of these die cast toy cars have a non-split axle design or a non-pivoting wheel connection. This limits the movement of the cars to forward and rearward motion only. To facilitate turning of the cars, the child must force the car to turn. Second, the weight of the cars are almost always top heavy, meaning the tires which are small, plastic and highly light weight (when compared to the rest of the car) are attached to a heavier die cast metal chassis and/or body. It being well known that this and other issues explained herein prevent the cars from landing on the wheels when jumping over a ramp or if the car does land on the wheels, the car will often bounce and roll (See Prior Art FIGS. 1A and 1B).

Therefore there is a need to provide for a small toy car that has the same or increased appeal seen in other small die-cast toy cars but with improved or enhanced aspects that hopefully increase the user's enjoyment of the toy while addressing some or all of these issues and other issues outlined herein.

SUMMARY OF THE INVENTION

One or more of the embodiments provided in the present invention relates to the small toy cars. In one embodiment there is provided a toy car that includes a chassis having four wheels rotatably attached thereto and having a body secured to the chassis. The four wheels have a first mass that is at least 40% of the total mass of the toy car. The first mass of the four wheels can also be at least 50%, 70% or 80% of the total mass. In another embodiment there is provided a toy car having a chassis, a body secured to an upper portion of the chassis, and four wheels. Each wheel having a center point defined therein, the four wheels being rotatably attached to the chassis body separately at the center point of each wheel, and the four wheels have a combined first mass such that a horizontally planar center of gravity defined by the toy car and measured from a lowest point on an outer edge of the four wheels towards a center of the chassis body is positioned substantially about the center point of the four wheels. Again the first mass of the four wheels can be defined to have a specified percentage of the total mass of the toy car. In either embodiment, the body may include an upper outer portion and the upper outer portion includes a finger detent.

Numerous other advantages and features of the invention will become readily apparent from the following detailed description of the invention and the embodiments thereof, from the claims, and from the accompanying drawings.

DESCRIPTION OF THE DRAWINGS

A fuller understanding of the foregoing may be had by reference to the accompanying drawings, wherein.

DETAILED DESCRIPTION OF THE EMBODIMENTS

Figure 1A:
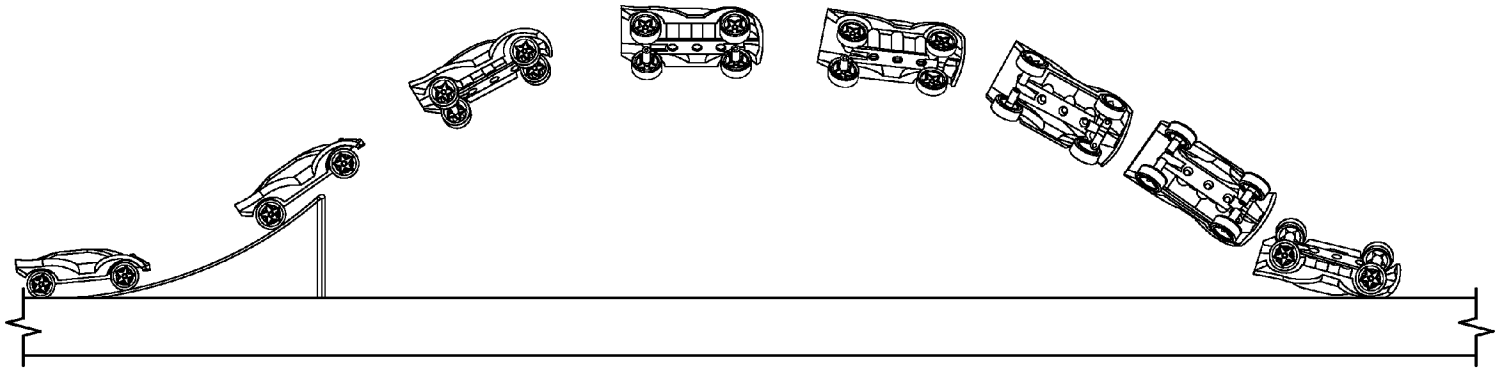
FIG. 1A (Prior Art)
FIG. 1*a* is a prior art figure showing in captured motion a typical response when a prior art small die cast toy is launched through a ramp.
Figure 1B:
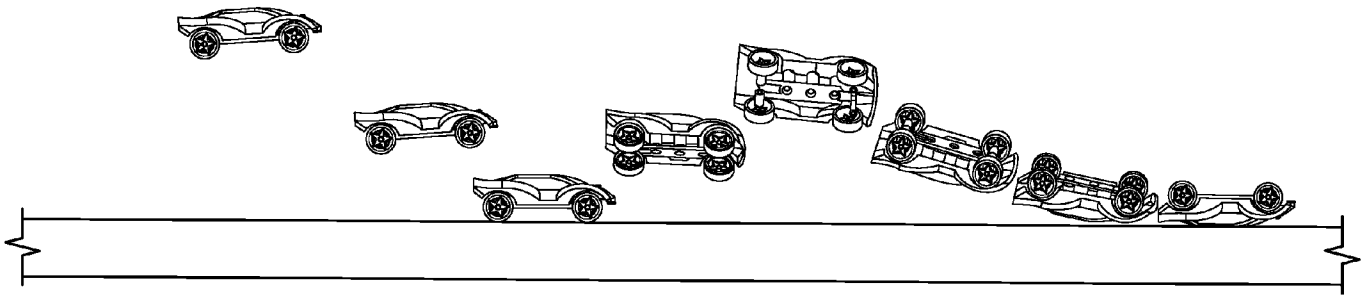
FIG. 1B (Prior Art)
FIG. 1*b* is a prior art figure showing in captured motion a typical response when a prior art small die cast toy landed on the ground from being launched.
Figure 2A:
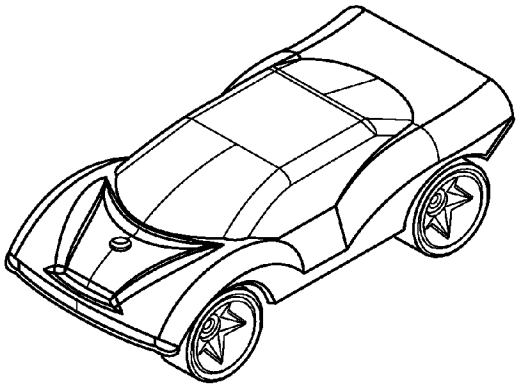
FIGS. 2A-2E illustrate a car in accordance to one or more of the embodiments defined herein, shown from various views.
Figure 2B:
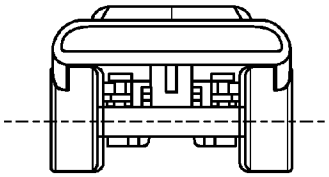
Figure 2C:
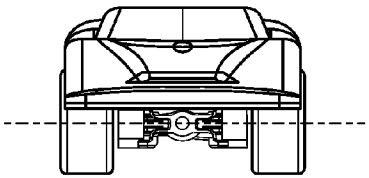
Figure 2D:
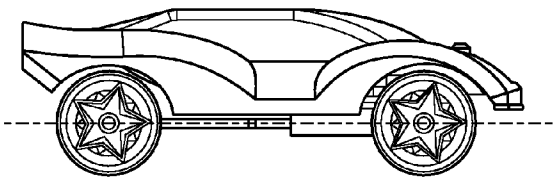
Figure 2E:
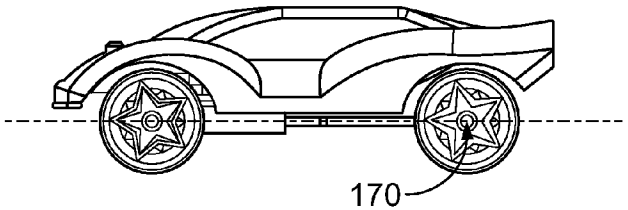

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or the embodiments illustrated.

Referring now to Figures, specifically to FIGS. 2A-2E, there is shown generally a toy car 100. As defined by one or more of the embodiments provided herein the cars have an entire length (front end to rear end) of about 3 inches or less, and preferably around 2 inches. The car 100 includes four wheels 105 separately and freely rotatably mounted to the car 100, as explained below. The vehicle also includes a one piece body 110. One aspect, which differentiates the car 100 from the prior art is the materials and the masses used to distinguish them. When assembled in accordance to the below discussed characteristics, the car 100 exhibits highly different qualities that a typical toy die cast car. Aiding in overcoming one or more of the aforementioned issues with the prior art.

In the first embodiment, the car 100 includes metal wheels 105 (as opposed to the plastic wheels employed in the prior art). The heavier metal wheels help the car land right side up after performing various stunts, such as but not limited to jumps, side turns, etc. The metal wheels enable unique play patterns such as jumping over ramps or going down miniature park stairs. The wheels may also be covered by an outer sleeve made from different materials such as hard plastic, soft plastic, rubber, etc., which when added to the wheels are able to change the performance of the vehicle.

In another embodiment, the wheels 105 are combined with an extremely light weight one piece body 110. Typically in this instance the body is a single molded plastic. When coupled with the heavy wheels the car 100 is properly balanced to perform the stunts and consistently lands on its wheels, without flipping or rolling on its back, discussed in greater detail below. The one piece body may be manufactured by injection molding to provide greater detail and different colors and styles, similar only to the look of cars in the prior art.

Figure 3A:
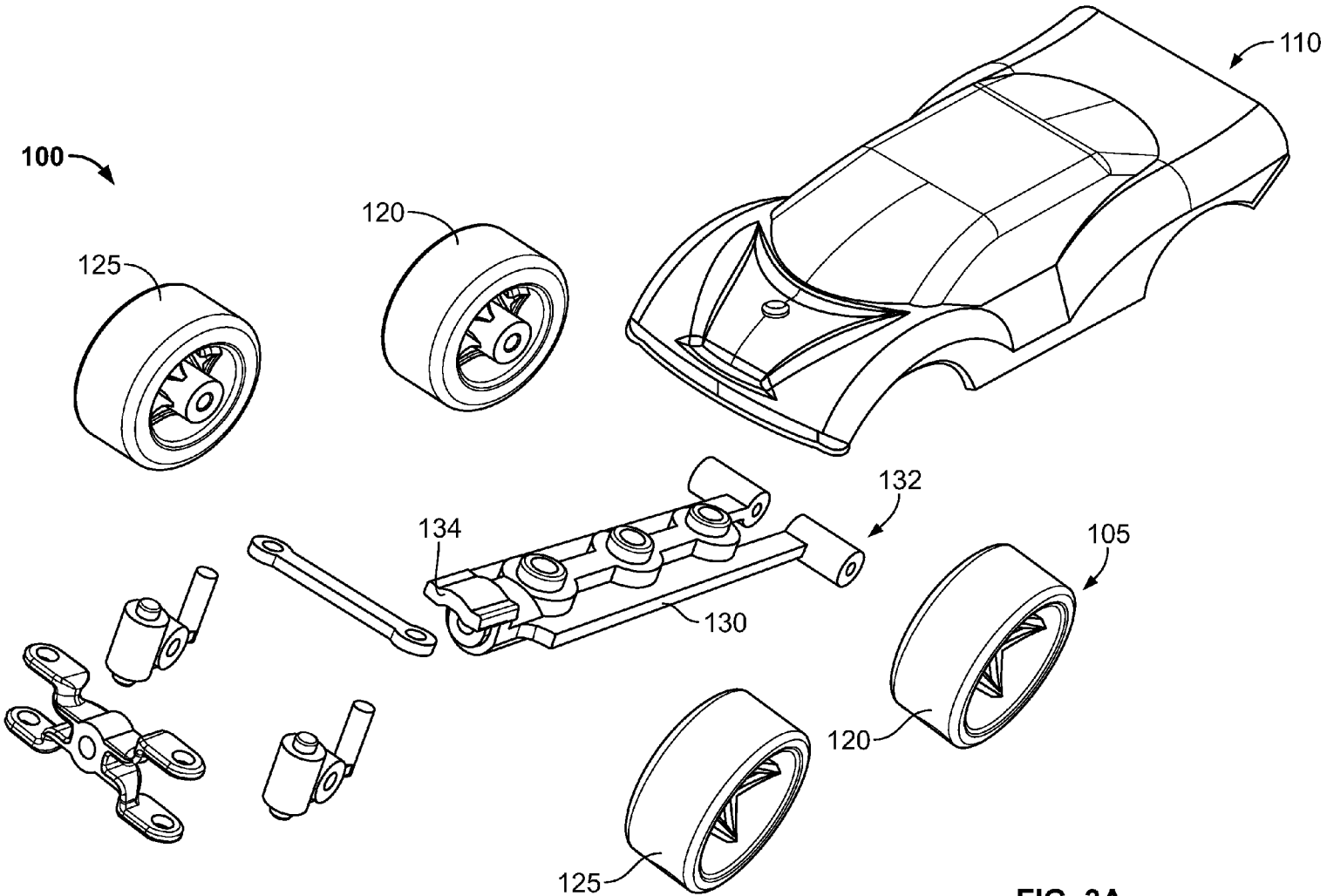
FIG. 3A is an exploded view of a car in accordance to one or more of the embodiments defined herein.
Figure 3B:
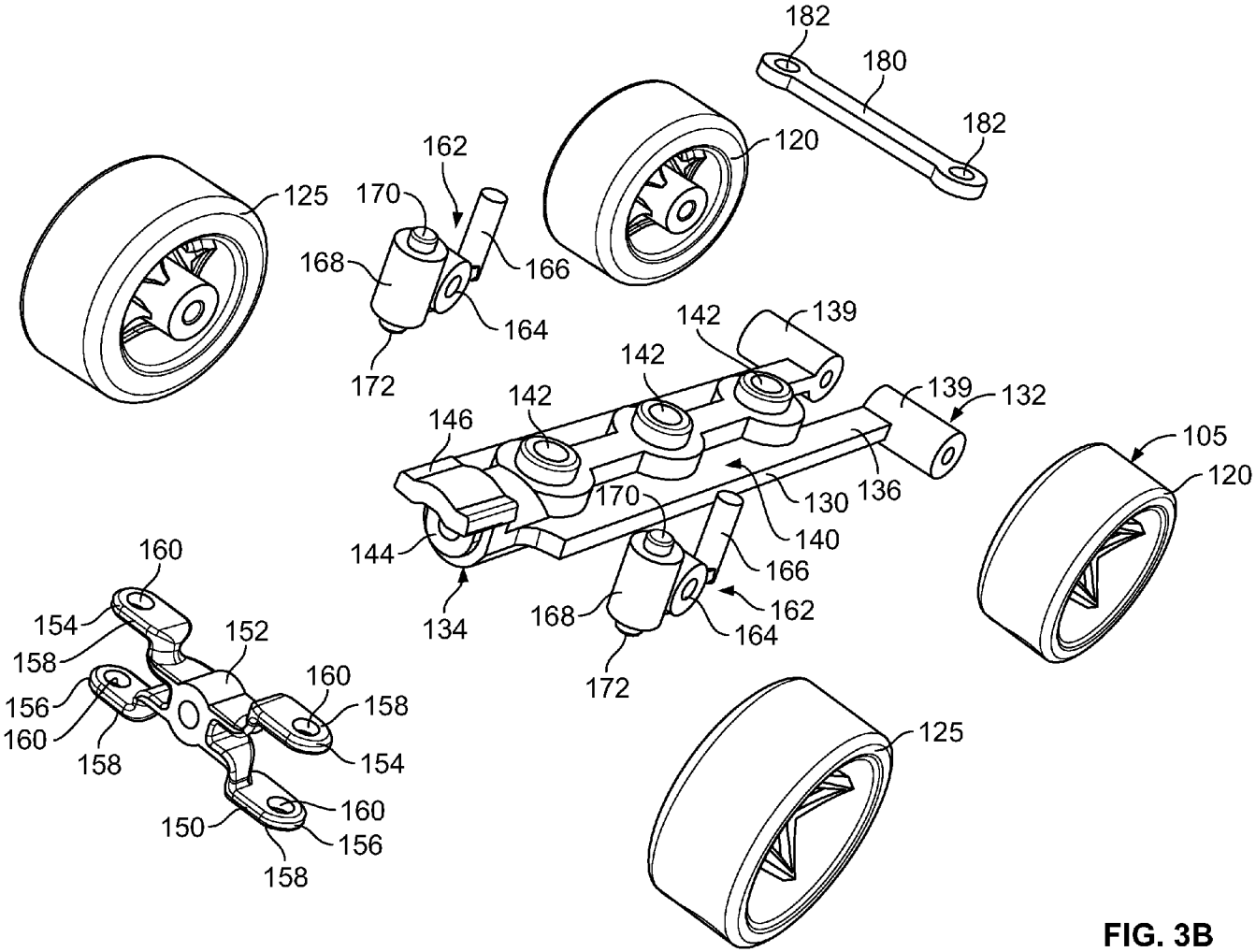
FIG. 3B is an enlarged exploded view of a chassis and front end sway suspension system of a car in accordance to one or more of the embodiments defined herein.
Figure 3C:
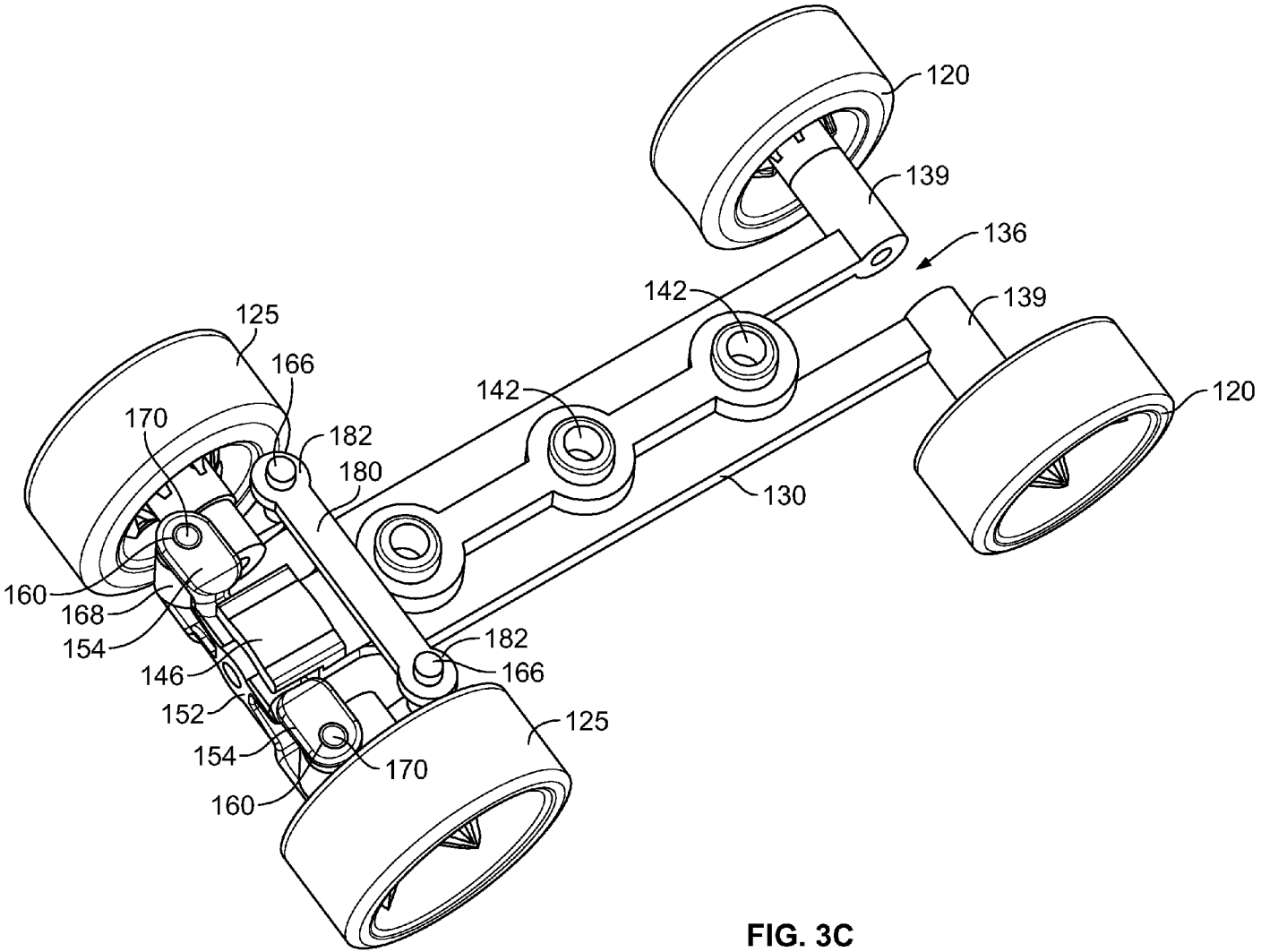
FIG. 3C is an enlarged sectional view of a chassis and front end sway suspension system of a car in accordance to one or more of the embodiments defined herein.

In another embodiment, the car 100 include the four metal wheels being freely and rotatably secured thereto. Referring to FIGS. 3A, 3B, and 3C, this is accomplished by connecting (via pins) the two rear wheels 120 to a rear portion 132 of a chassis 130 and connecting (also be pins) the two front wheels 125 to a front end sway suspension system 150, which is connected to a front portion 134 of the chassis 130. In one or more of the embodiments, the wheels are separately connected to provide for complete independent rotation with respect to each other, as opposed to provided axles running across the chassis tying sets of wheels together.

The chassis 130 includes a rear portion 132 that includes a Y shaped or split end 136 shaped to provide for separate connections to the two rear wheels 120. Each branch 138 of the split end 136 includes a receptacle 139 for receiving the end of a pin to secure a rear wheel in place.

The chassis 130 also includes a main body portion 140 positioned between the rear portion 132 and the front portion 134. The main body portion 140 includes at least one vertical male or female member 142 to secure the chassis 130 to the body 110, this can be accomplished by a snap frictional fitment with corresponding members extending or recessed on the body or can be accomplished by providing an opening for pins. However, to help reduce upper weight, a snap fitment may be preferable. In addition, the body may include various other well known methods to attach and secure itself to the chassis, including but not limited to a snap fit around different engagement points about the edges of the chassis.

The front portion 134 of the chassis 130 includes a longitudinal male or female member 144 arranged about an axis of the chassis. The longitudinal member 144 is capable of mating to a corresponding structure on the front end sway suspension system 150. The front portion 134 of the chassis 130 further may include an extension header 146 extending from the front portion 134 to be positioned over a center section 152 of the front end sway suspension system 150 to provide support.

The front end sway suspension system 150 includes a front suspension member 151 that is shown in one embodiment to have an X shape, defined as having the center section 152 with upper 154 and lower legs 156 extending out from the center section on either side. Each leg includes a substantially horizontal flange 158 extending therefrom with an opening 160 defined on each flange 158 such that the openings on each pair of upper and lower legs face one another. The front wheels 125 as secured to the front end sway suspension system 150 by attaching each wheel separately to a caster 162. Each caster 162 includes a receptacle 164 to receive the pin to secure a front wheel. Positioned on one side of the receptacle 164 is a upwardly positioned rod 166, which as discussed below receives an end 182 of a sway bar 180. Positioned on the opposite side of the receptacle 164 is a peg 168 having an upper projection 170 and a lower projection 172. The upper and lower projections 170 and 172 of the peg 168 are positioned into the openings 160 on a pair of flanges 158 defined on the upper and lower legs of the x shaped front suspension member. A small amount of clearance should be provided in the length of the peg 168 to allow for a rotation of the peg and in some instances even a small amount of vertical movement of the wheel when rolling may be permissible. In addition, as mentioned a sway bar 180 is provided to seat across the top of the front portion 134 of the chassis 130. The ends 182 of the sway bar 180 are positioned and/or secured to the rods 166 on the casters 162. When assembled, the car will be provided with the capability of turning the front wheels. The sway bar 180 assisting the front wheels to turn together.

The components of the chassis 130 and the a front end sway suspension system 150 are also preferably a light weight to help the overall balance of the car. In addition, the front end sway suspension system provides for a true realistic feel during play and helps the car during stunts. The combination of the light body, heavy wheels and loose rack and pinion steering allow the car to roll up a ramp and turn around at the apex and then roll down front forward. As opposed to prior art cars which roll down rear forward.

As mentioned above the materials used in the construction of the car 100 play an important role on the performance of the vehicle, simply because the mass of the car 100 is proportioned according to one or more of the following parameters: in one embodiment the percent of the wheels mass to the total mass of the car is 40% or greater; in a second embodiment the percent of the wheels mass to the total mass of the car is 50% or greater; in a third embodiment the percent of the wheels mass to the total mass of the car is 70% or greater; and in a forth embodiment the percent of the wheels mass to the total mass of the car is 80% or greater. Moreover, since the total mass of the car is positioned in the wheels and the rest of the car is extremely light weight, the horizontal position of the center of gravity (measured from a bottom of the wheel) hovers right at or above the wheels 105 centerline 107. In one embodiment of having the percent of the wheels mass to the total mass of the car being about 70%, the total mass of the car was 21.67 grams with the wheels mass being about 15 grams. In one embodiment of having the percent of the wheels mass to the total weight of the car being about 80% (the total mass of the car was 24.81 grams with the wheels accounting for 19.72 grams), the center of gravity was 0.05 mm above the centerline 107 of the wheels 105.

Figures 4, 4A:
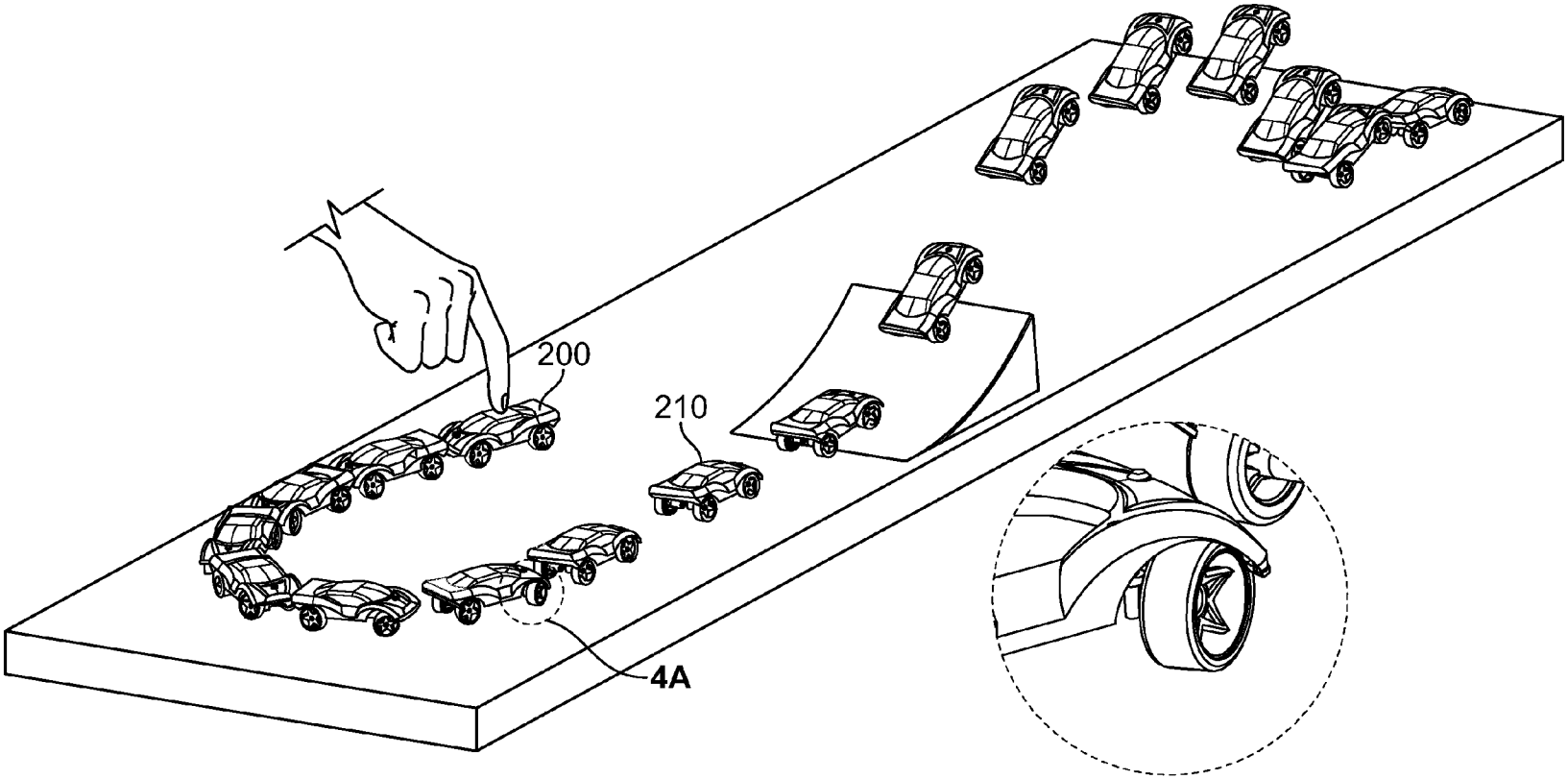
FIG. 4A is an enlarged sectional view of 4A from FIG. 4 illustrating the turning of a wheel.
FIG. 4 is an illustrated movement diagram showing a car in accordance to one or more of the embodiments defined herein turning and jumping over a ramp.
Figure 5A:
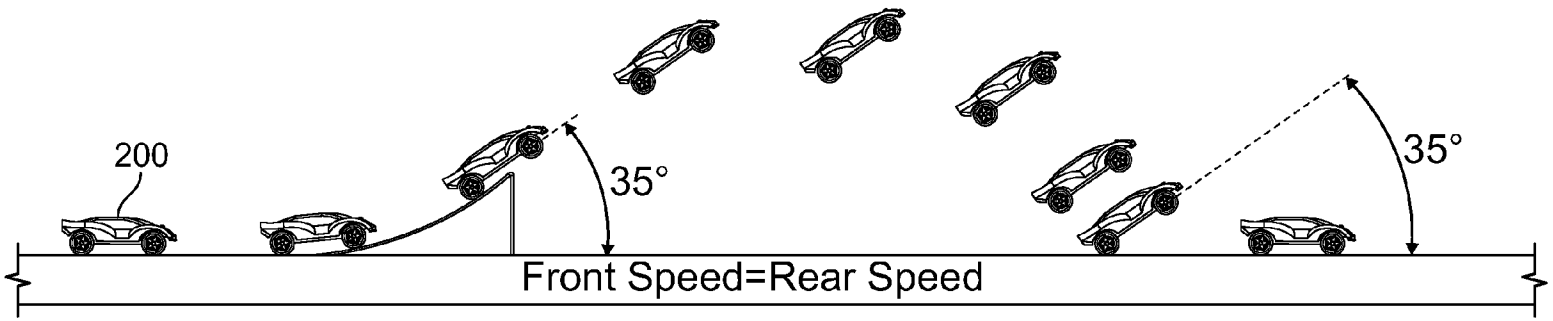
FIG. 5A is an illustrated movement diagram showing a car in accordance to one or more of the embodiments defined herein jumping over a ramp where the front speed is substantially equal to the rear speed.
Figure 5B:
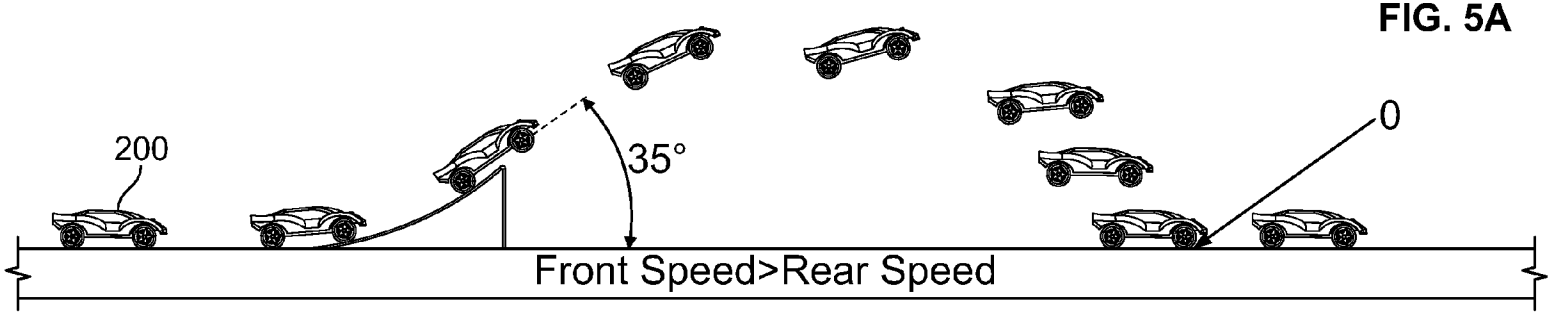
FIG. 5B is an illustrated movement diagram showing a car in accordance to one or more of the embodiments defined herein jumping over a ramp where the front speed is greater then the rear speed.
Figure 5C:
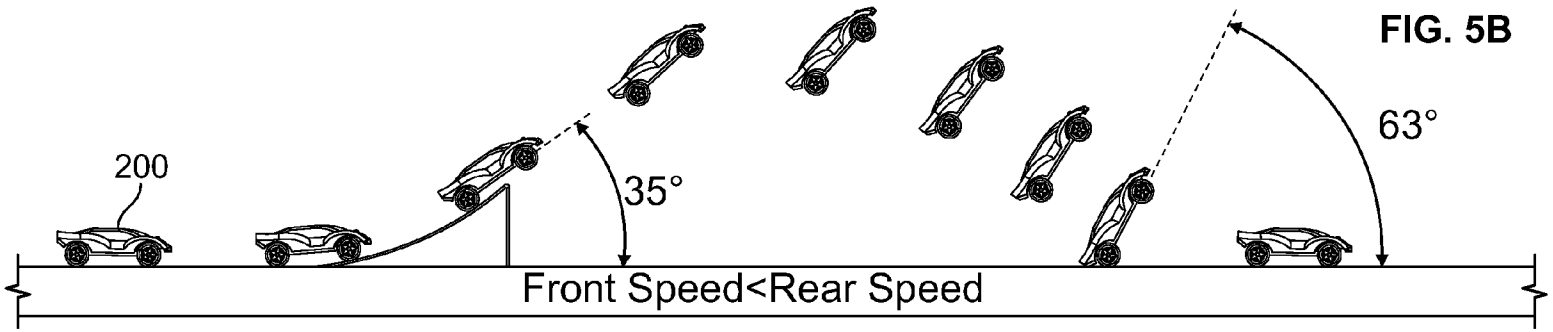
FIG. 5C is an illustrated movement diagram showing a car in accordance to one or more of the embodiments defined herein jumping over a ramp where the front speed is less then the rear speed.
Figure 6A:
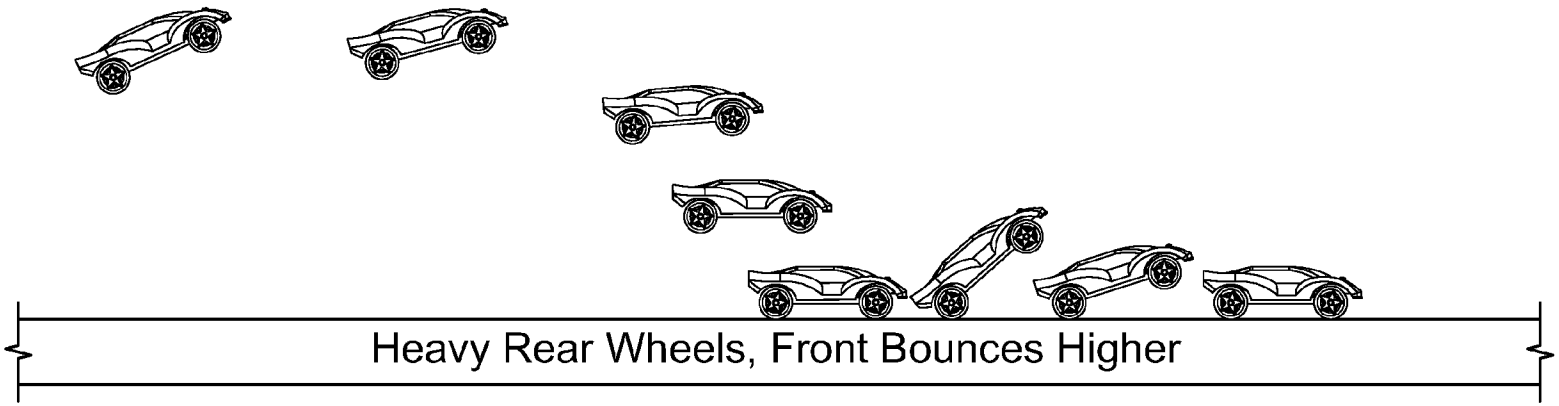
FIG. 6A is an illustrated movement diagram showing a car in accordance to one or more of the embodiments defined herein landing where the rear wheels are heavier then the front wheels.
Figure 6B:
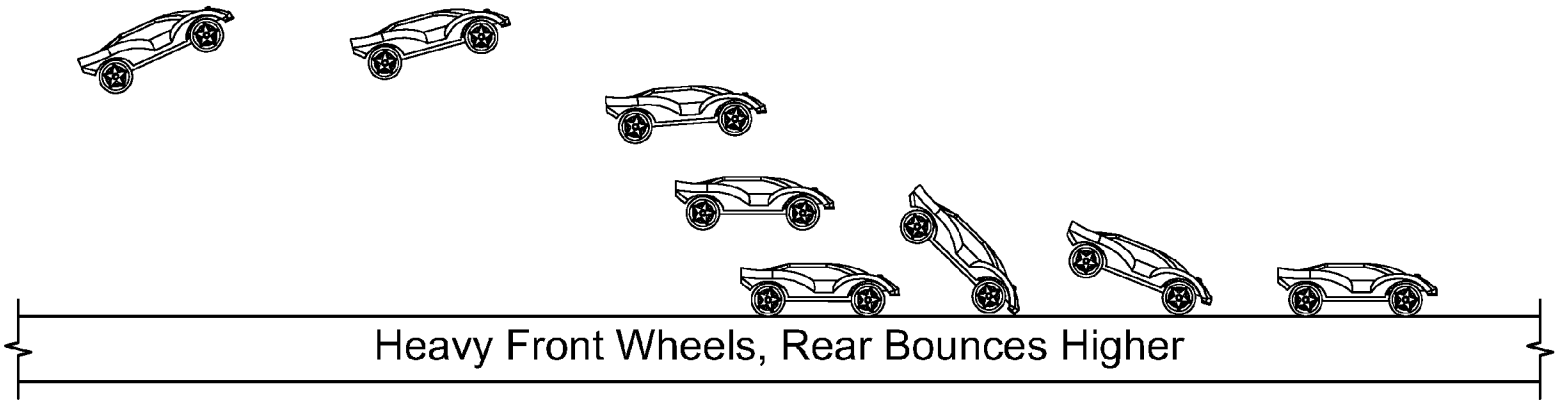
FIG. 6B is an illustrated movement diagram showing a car in accordance to one or more of the embodiments defined herein landing where the front wheels are heavier then the rear wheels.
Figure 7A:
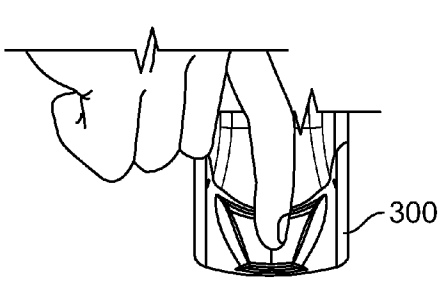
FIGS. 7A through 7D shows in various views a car in accordance to one or more of the embodiments defined herein having a finger knob to help control the vehicle.
Figure 7B:
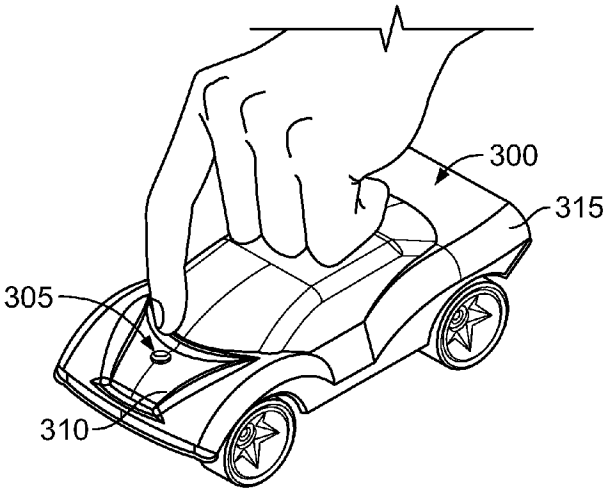
Figure 7D:
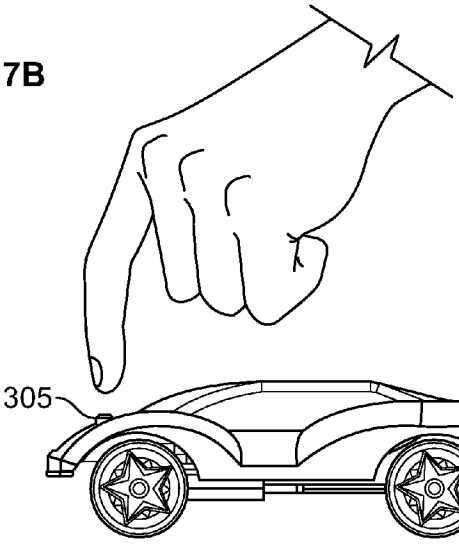
Figure 7C:
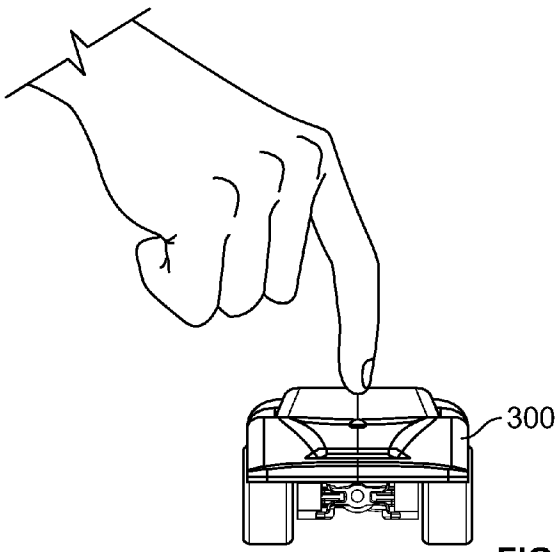
Figure 8A:
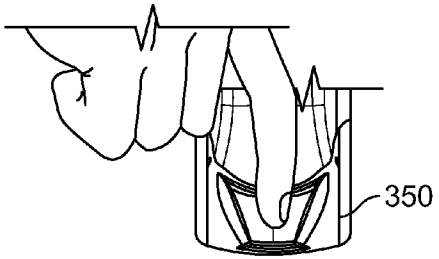
FIGS. 8A through 8D shows in various views a car in accordance to one or more of the embodiments defined herein having a indentation to help control the vehicle.
Figure 8B:
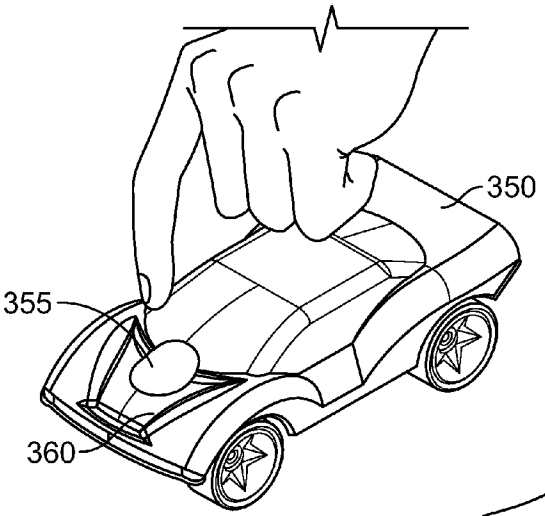
Figure 8C:
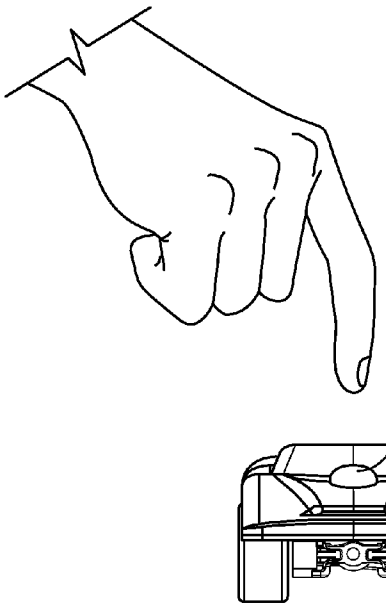
Figure 8D:
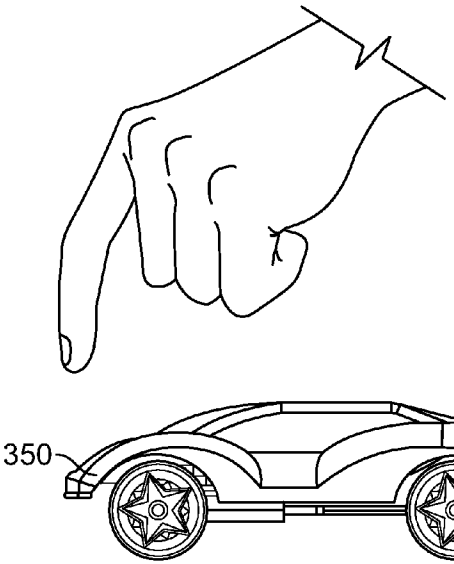

Referring now to FIG. 4, a car 200 designed in accordance with one or more of the above noted embodiments, is typically operated with a user's finger. The user would drive the car 200 around which would permit turning (shown in Detail 4A) and then permit the user to launch the car 200 over a ramp. With a push of the finger the user can allow the car 210 to be released to travel freely over the ramp. As further shown in FIGS. 5A through 5C, the car 200 is capable of jumping over a ramp and landing on its wheels. Under different scenarios, the car 200 will react different through the jump but will land on its wheels without rolling or flipping over. With further reference to FIGS. 6A and 6B, the car 200 can exhibit the same positive results even when the weight of the wheels (between the front and rear) are not balanced.

Referring now to FIGS. 7A-7D, in another embodiment there is shown a car 300 designed in accordance with one or more of the above noted embodiments. The car 300 further includes a finger knob 305 protruding from a top portion 310 of the vehicle body 315. The knob 305 allows a user to put pressure on and securely hold onto the vehicle while maneuvering. In yet another embodiment, there is shown in FIGS. 8A-8D a car 350 that includes an indentation 355 on a top portion 360 of the vehicle body 360.

Figure 9A:
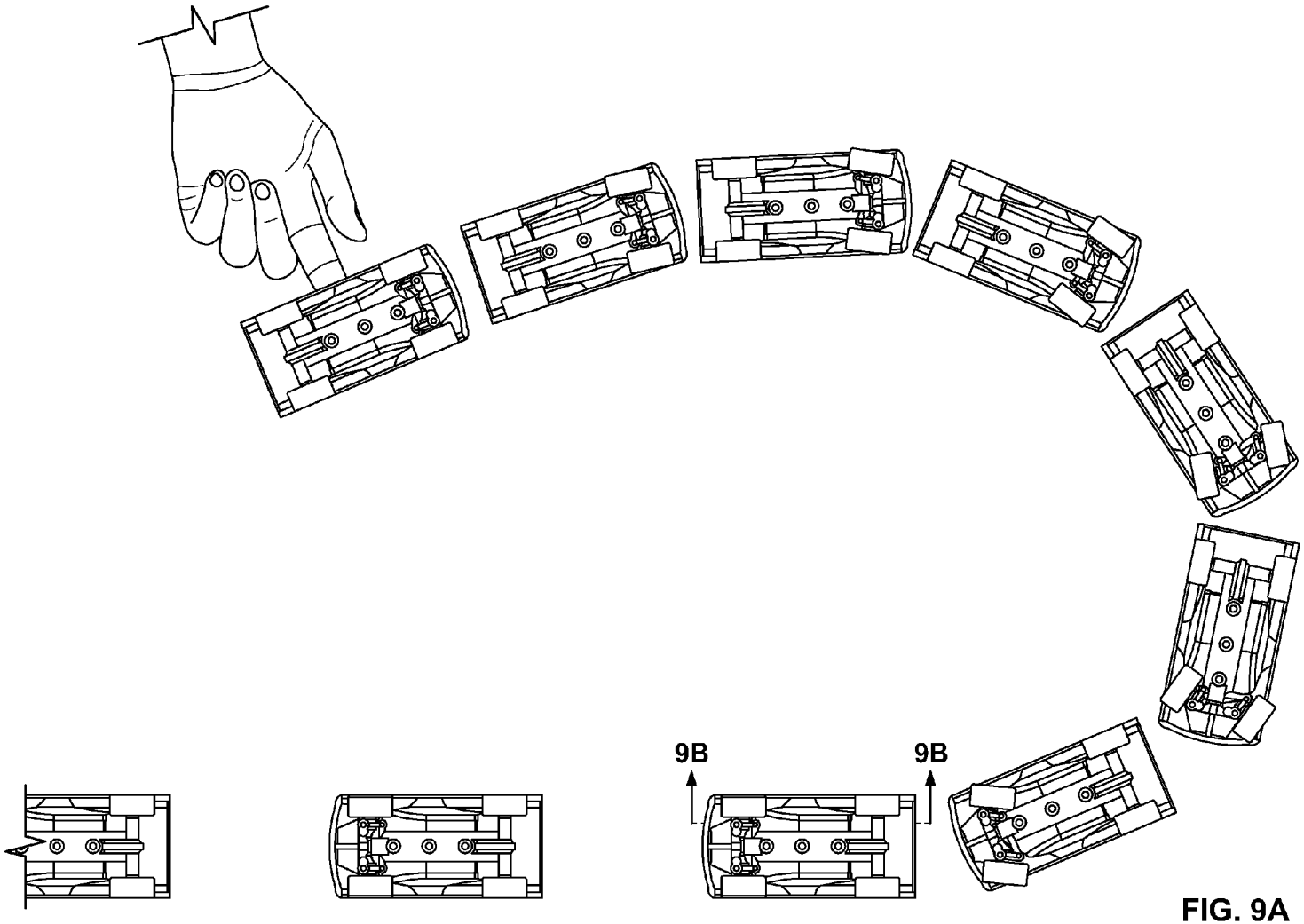
FIGS. 9A through 9B shows in various views a car in accordance to one or more of the embodiments defined herein having a positive caster.
Figure 9B:
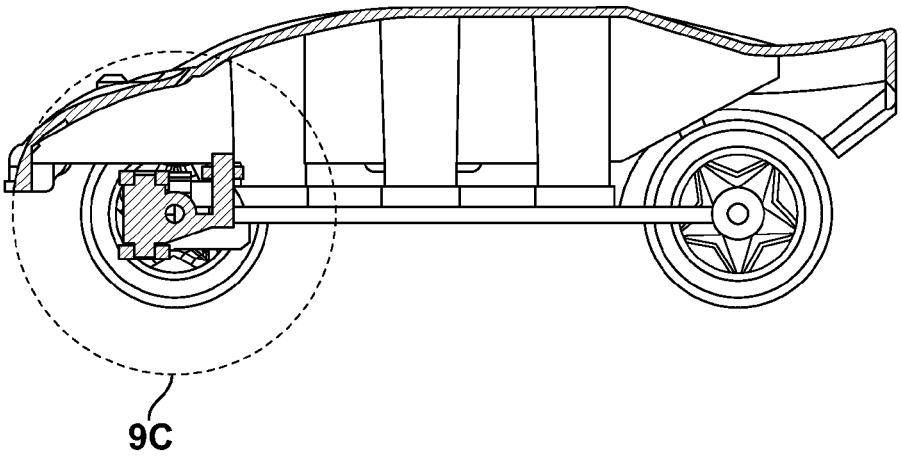
Figure 9C:
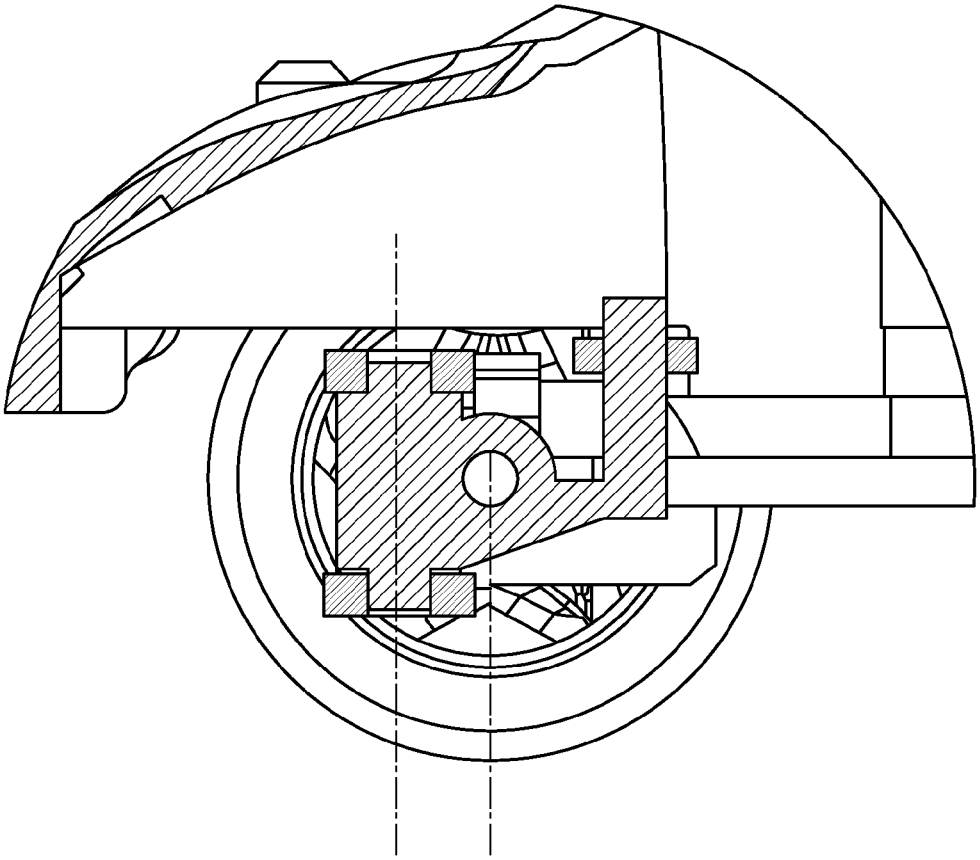
Figure 10:
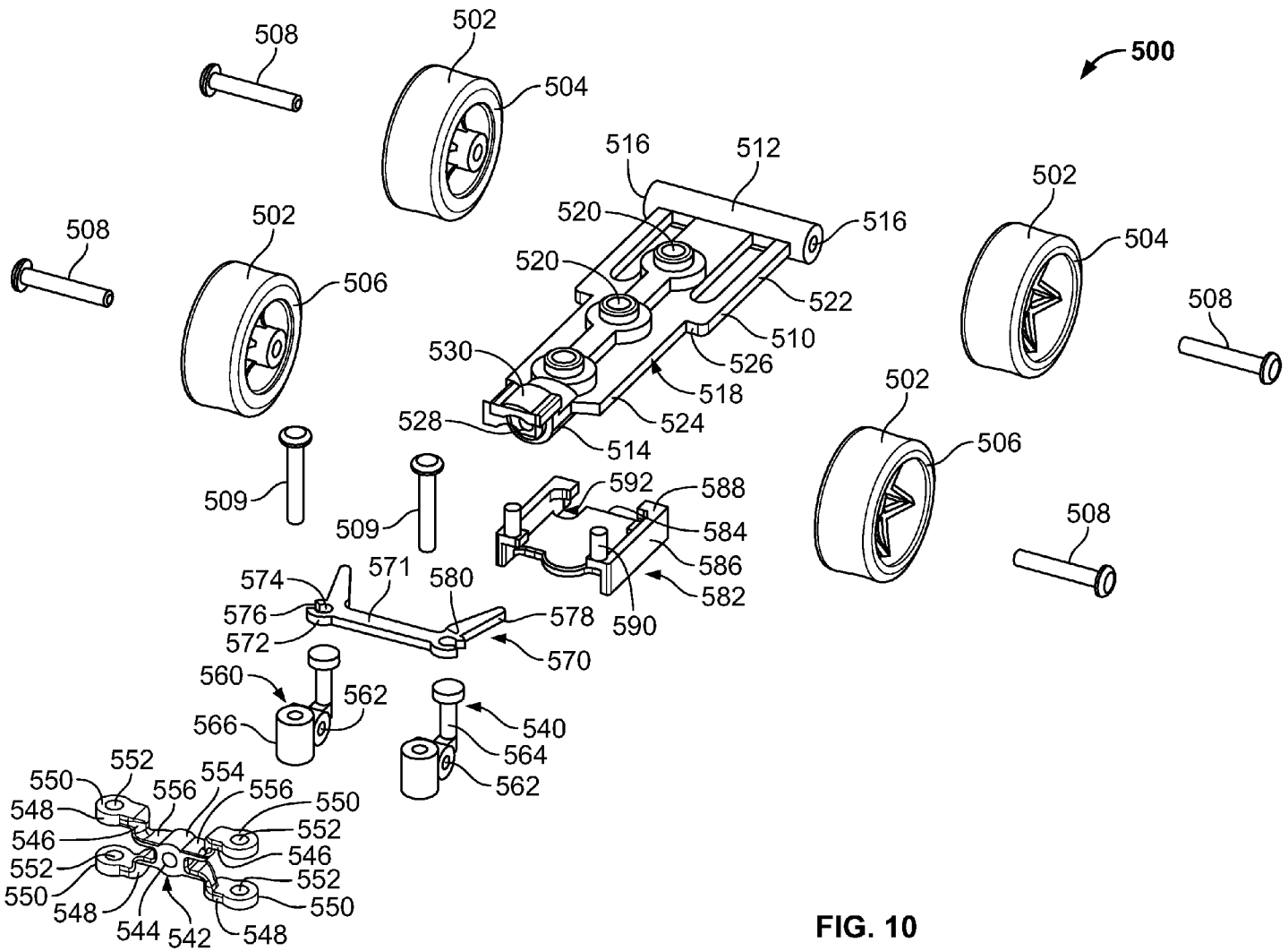
FIG. 10 is an enlarged sectional view of a chassis and front end sway suspension system of a car in accordance to one or more of the embodiments defined herein.

As shown in FIGS. 9A, 9B and 9C a car 400 is illustrated from the underside of the vehicle. In the movements shown the turning of the vehicle shows the front wheels pivoting to allow for greater control by the user. In addition, the forward position of a caster 405 for the front wheels of about 2.2 mm offset from the axis of the wheel can permit for the car 400 to move and pivot in different directions similar to a real car. In other embodiment the offset can be from about 1 to 4 mm. It being known that the smaller the offset the larger the angle of turn will be exhibited. A positive caster also enables the car to self correct and travel in a more substantially straight line. An aspect that is non-existent with prior art scaled cars. Further embodiments can also include a slide mechanism that allows the user to lock the front wheels for various specific types of play.

In addition, it has been determined that the heavier the wheel mass percentage to the overall mass of the vehicle the less the vehicle will bounce when landing. Furthermore, the less elastic the wheel, the less the bounce. In both instances the car's performance can be tailored to the level and type of play. It could further be determined that interchangeable wheels and bodies that have various weights can be introduced to changes the aspects by the user. Packaged together with a tightening tool to remove pins or small screws (holding the wheels and body to the vehicle), the user can change the performance of the vehicle during play.

Referring now to FIGS. 10 through 12D, there is shown a car 500 (without the plastic body) with four metal wheels 502 being freely and rotatably secured by pins 508 to the vehicle. Two rear wheels 504 are attached to a rear portion 512 of a chassis 510 and the two front wheels 506 are attached to a front end sway suspension system 530, which is connected to a front portion 514 of the chassis 510. In one or more of the embodiments, the wheels are separately connected to provide for complete independent rotation with respect to each other, as opposed to provided axles running across the chassis tying sets of wheels together.

The chassis 510 includes a rear portion 512 that includes a receptacle 516 on either side of the chassis 510 for receiving the end of a pin 508 to secure a rear wheel in place.

The chassis 510 also includes a main body portion 518 positioned between the rear portion 512 and the front portion 514. The main body portion 518 includes at least one vertical male or female member 520 to secure the chassis 510 to a body (not shown), this can be accomplished by a snap frictional fitment with corresponding members extending or recessed on the body or can be accomplished by providing an opening for pins. However, to help reduce upper weight, a snap fitment may be preferable. In addition, the body may include various other well known methods to attach and secure itself to the chassis, including but not limited to a snap fit around different engagement points about the edges of the chassis.

The main body portion 518 of the chassis 510 includes a rear section 522 and a forward section 524. The forward section 524 is narrower then the rear section 522 in order to accommodate a sliding lock mechanism 582 (discussed in greater detail below). Since the rear section 522 is larger then the forward section, the sliding lock mechanism 582 when slid towards the rear wheels 504 will stop at the forward edge 526 of the rear section 522. The transition between the forward and rear sections of the chassis can be tapered at an angle or positioned as shown as a more straight edge transition.

The front portion 514 of the chassis 510 includes a longitudinal male or female member 528 arranged about an axis of the chassis 510. The longitudinal member 528 is capable of mating to a corresponding structure on the front end sway suspension system 540. The front portion 514 of the chassis 510 further may include a extension header 530 extending from the front portion 514 to be positioned over a center section 562 of the front end sway suspension system 540 to provide a horizontal pivot stop about the chassis axis (as discussed in greater detail below).

The front end sway suspension system 540 includes a front suspension member 542 that is shown in one embodiment to have an X shape, defined as having the center section 544 with upper 546 and lower legs 548 extending out from the center section on either side. Each leg includes an extending flange 550 with an opening 552 defined on each flange 550 such that the openings on each pair of upper and lower legs face one another. The center section 544 includes an arcuate upper center portion 554 that includes side ledges 556 positioned into the upper legs 546.

The front wheels 506 are secured to the front end sway suspension system 540 by attaching each wheel separately to a caster 560. Each caster 560 includes a receptacle 562 to receive the pin 508 to secure a front wheel. Positioned on one side of the receptacle 562 is a upwardly positioned rod 564, which as discussed below receives an end 572 of a sway bar 570. Positioned on the opposite side of the receptacle 562 is a cylinder 566 bored there-through to receive a pin 509 which aligns and sets into the openings 552 on a pair of flanges 550 defined on the upper and lower legs of the x shaped front suspension member 542. A small amount of clearance should be provided in the length of the cylinder 566 to allow for a rotation of the cylinder and as explained below also allow for vertical movement of the wheel when rolling.

In addition, as mentioned a sway bar 570 is provided to include a bar 571 positioned across the top of the front portion 514 of the chassis 510. The ends 572 of the bar 571 are positioned and/or secured to the rods 564 on the casters 560. The ends 572 are shown to include a circular notch 574 sized to fit around the rod 564 with a side opening 576 to allow the rods to snap fit into the circular notch 574. In addition, the bar 571 also includes a pair of guide posts 578 separately extending from each end 572 outwardly and rearwardly from the bar 571 towards the rear of the vehicle. At or near the junction of the guide posts 578 to the end 572 is a inward notch 580.

Lastly, the sliding lock mechanism 582 is defined to include a base member 584 and a pair of side walls 586 extending at an edge of the base member 584. The side walls 586 terminate to a inwardly turned lip 588 (that may or may not extend along the entire side wall 586). This creates a channel 592 between the base member and inwardly turned lips 588 that is sized to receive the forward section 524 of the chassis 510, with the base member 584 being positioned on the underside of the chassis and the lips 588 being positioned on the upperside of the chassis. The sliding lock mechanism 582 further includes a pair of locking posts 590 that are able to slid into the inward notches 580 positioned on the guide posts 578 on the sway bar 570.

Figure 11A:
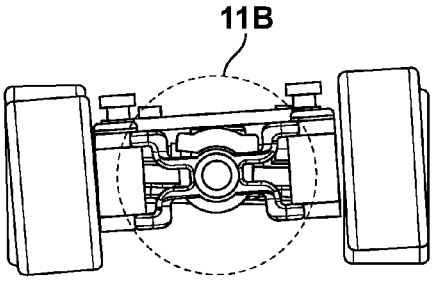
FIG. 11A is a front view of the embodiment disclosed in FIG. 10.
Figure 11B:
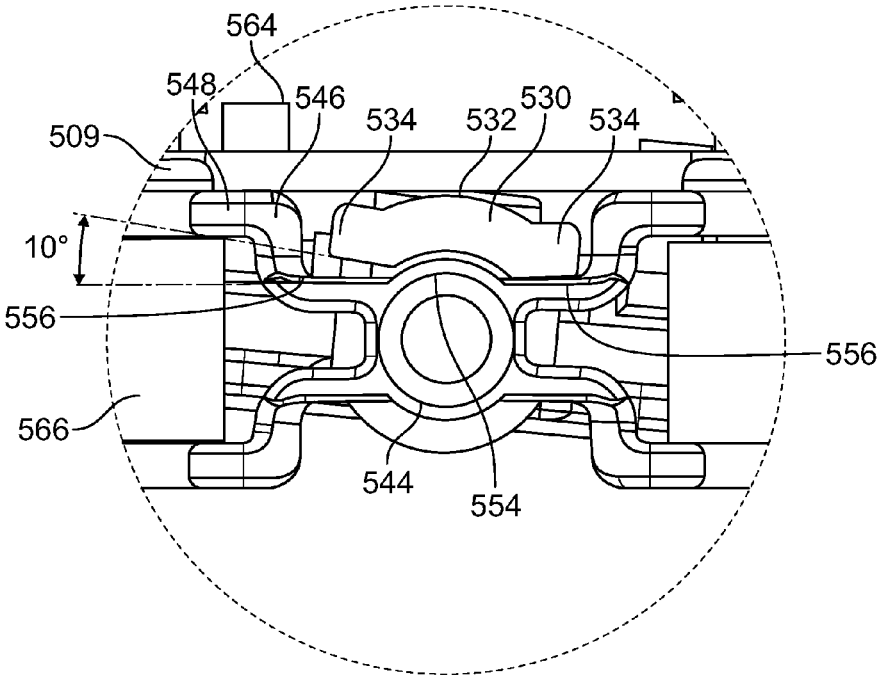
FIG. 11B is an enlarged section view of the front end from FIG. 11A.

Referring now to FIGS. 11A and 11B, when assembled, the car will be provided with the capability of turning the front wheels, as aspect not provided for in small die cast cars. The sway bar 570 assisting the front wheels to turn together. Furthermore, as shown in FIG. 11 the extension header 530 extending from the front portion 524 is positioned over the center section 544 of the front end sway suspension system 542.

The header 530 includes an arcuate upper center 532 that includes side angled ledges 534. This is set to accommodate the center section 544 on the front end sway suspension system 542, namely the arcuate upper center 532 of the header 530 fits over the arcuate upper center portion 554 and the angled side ledges 534 of the header permit the pivoting of the front end sway suspension system 542 until the side ledges 556 come into contact with the angled side ledges 534. As provided in one embodiment a 10 degree total axle rotation is provided, however, this could be changed from 0 to 45 degrees, depending on the amount of rotation one wants to provide.

Figure 12A:
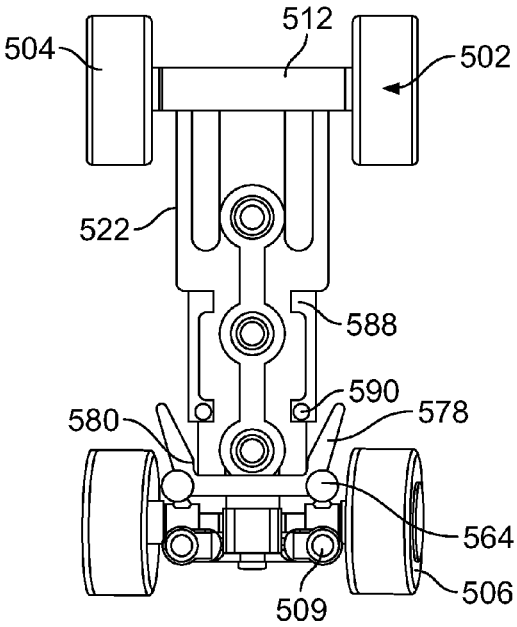
FIG. 12A is a top view of the embodiment disclosed in FIG. 10 illustrating the sliding lock mechanism unengaged.
Figure 12B:
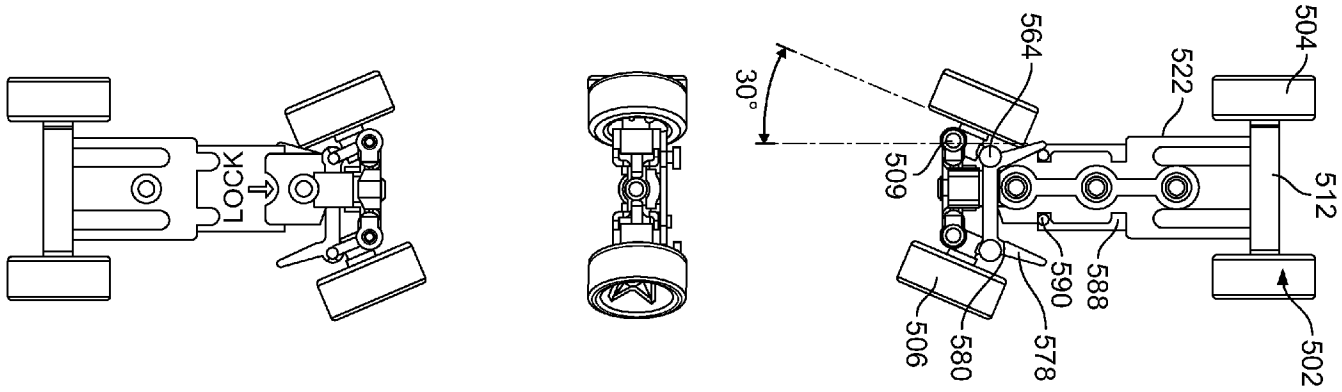
FIG. 12B illustrates the embodiment disclosed in FIG. 10 illustrating the sliding lock mechanism unengaged with the wheels tilted.
Figure 12C:
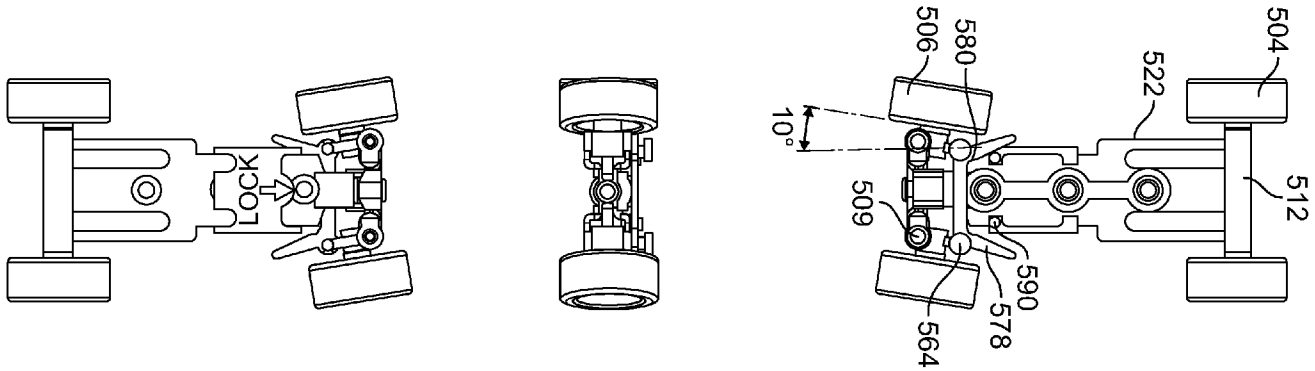
FIG. 12C illustrates the embodiment disclosed in FIG. 10 illustrating the sliding lock mechanism partially engaged with the wheels partially tilted.
Figure 12D:
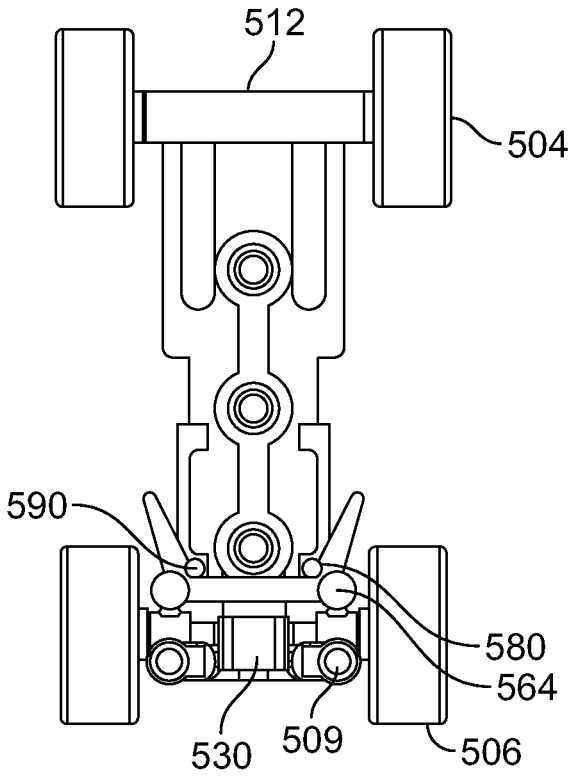
FIG. 12D illustrates the embodiment disclosed in FIG. 10 illustrating the sliding lock mechanism engaged with the wheels locked in the forward position.

As further shown in FIGS. 12A through 12D, the sliding locking mechanism is shown in various positions. In FIGS. 12A and 12B the sliding locking mechanism is fully unengaged permitting full turning. In FIG. 12C the sliding locking mechanism is partially engaged permitting only partial turning of the suspension system. In FIG. 12D the sliding locking mechanism is fully engaged restricting the turning of the suspension system.

Figure 13A:
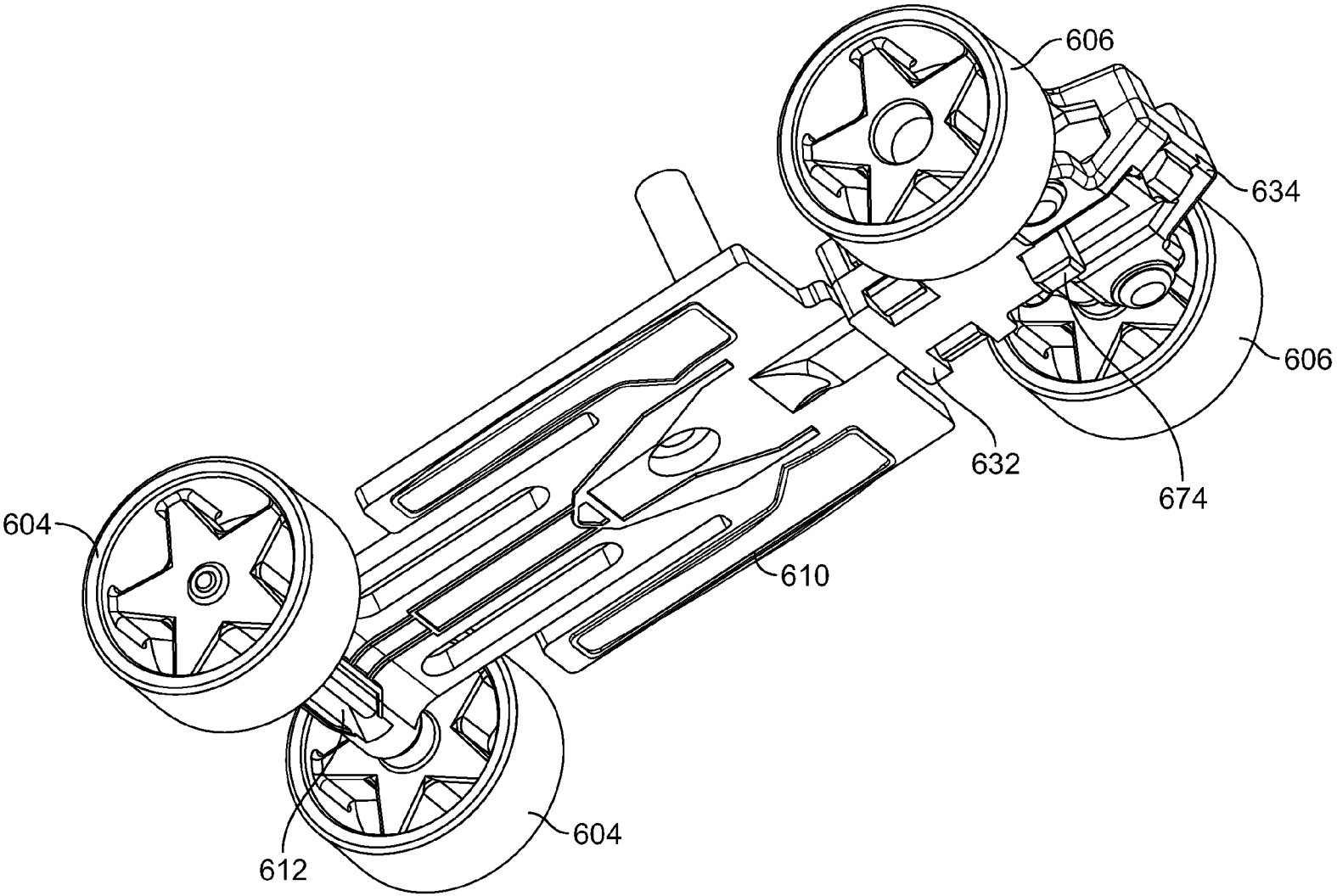
FIG. 13A is a top view perspective of another embodiment illustrating another type of a chassis suspension system.
Figure 13B:
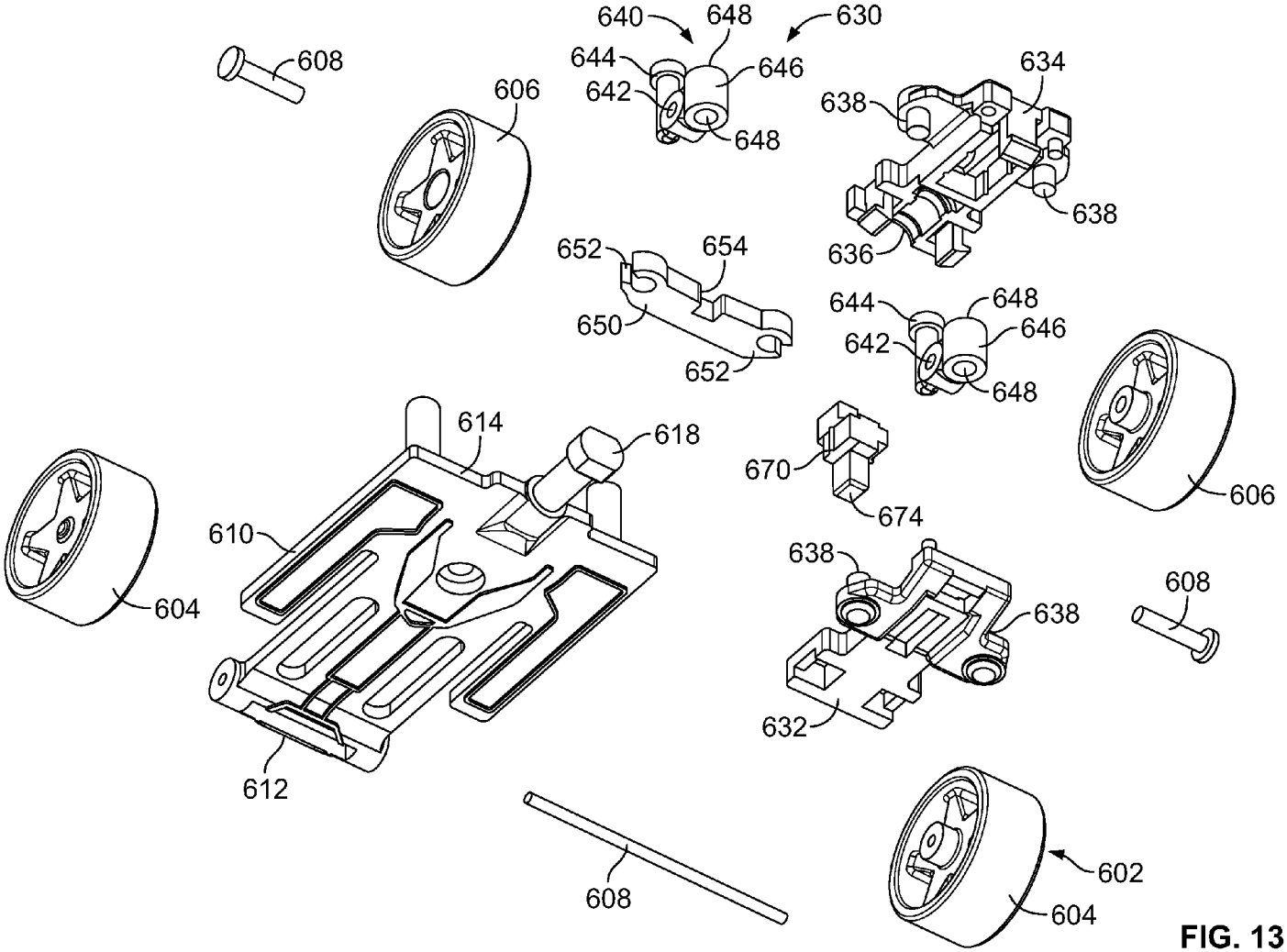
FIGS. 13B and 13C are exploded views of FIG. 13A from various angles.
Figure 13C:
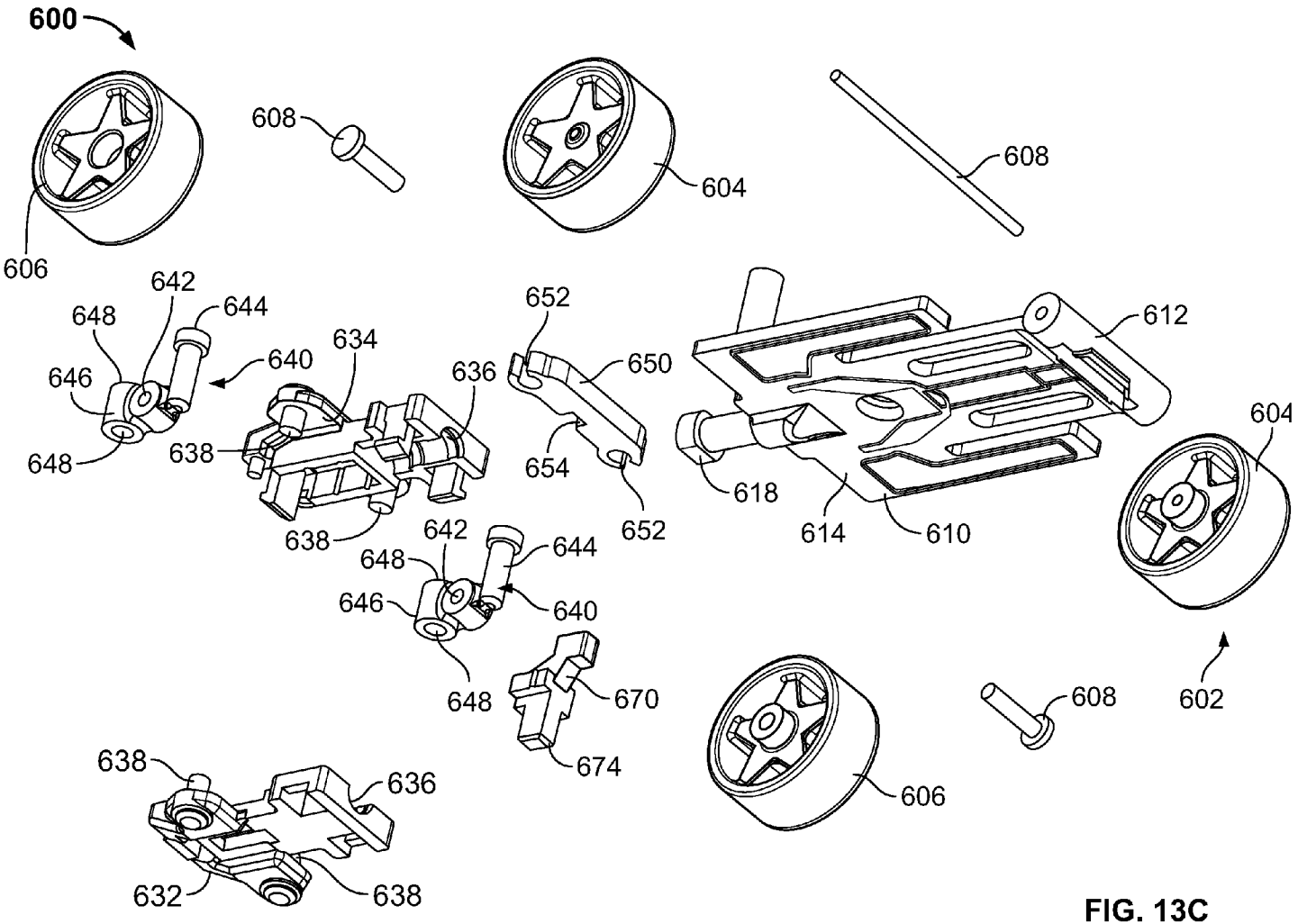

Referring now to FIGS. 13A through 13C, there is shown a car 600 (without the plastic body) with four metal wheels 602 being freely and rotatably secured by pins 608 to the vehicle. Two rear wheels 604 are attached to a rear portion 612 of a chassis 610 and the two front wheels 606 are attached to a front end sway suspension system 630, which is connected to a front portion 614 of the chassis 610.

The front portion 614 of the chassis 610 includes a longitudinal member 618 extending 618 therefrom and positioned to be received by an opening 632 defined by the front end sway suspension system 630, disclosed herein below.

The front end sway suspension system 630 includes a top suspension member 632 and a bottom suspension member 634 that secure to one another. Both the top suspension and bottom suspension members 632 and 634 include a groove 636 that combined create the opening 632 when the two members are connected. The top and bottom suspension members further includes a pair of pins 638 opposing each other.

The front wheels 606 as secured to the front end sway suspension system 630 by attaching each wheel separately to a caster 640. Each caster 640 includes a receptacle 642 to receive the pin 608 to secure a front wheel 606. Positioned on one side of the receptacle 642 is an upwardly positioned rod 644, which as discussed below receives an end 652 of a sway bar 650. Positioned on the opposite side of the receptacle 642 is a cylinder 646 having upper and lower openings 648, sized to receive the opposing pairs of pins 638.

Therefore, when the top and bottom suspension members 632 and 634 are secured to each other, the opposing pins 638 capture and secure the casters 640 to the front end sway suspension system 630 and thus secure the front wheels thereto.

As mentioned, the upwardly positioned rods 644 on the two casters 640 are secured to ends 652 of the sway bar 650. In addition, the sway bar 650 includes a notch 654 along its length and is positioned to receive a portion 672 of a locking mechanism 670. The locking mechanism 670 includes a bottom section 674 that extends through the chassis 610 to permit a user to move or slid the locking mechanism into and out of engagement with the notch 654 of the sway bar 650. When engaged, the locking mechanism 670 stop or prevents the sway bar from moving and therefore prevents turning of the wheels. When not engaged, the sway bar 650 permits full movement of the wheels in both turns and upward/downward suspension type movement caused by small amounts of clearance between the top and bottom suspension members and the casters (where the pins 638 and openings 648 connect).

The embodiments provided for in the invention provide for a quick maneuverable small die cast toy car that is capable of moving easily over various terrains, capable of jumping and spinning while balanced properly such that the car will tend to land on its wheels as opposed to flipping over and landing on its top.

Figure 13D:
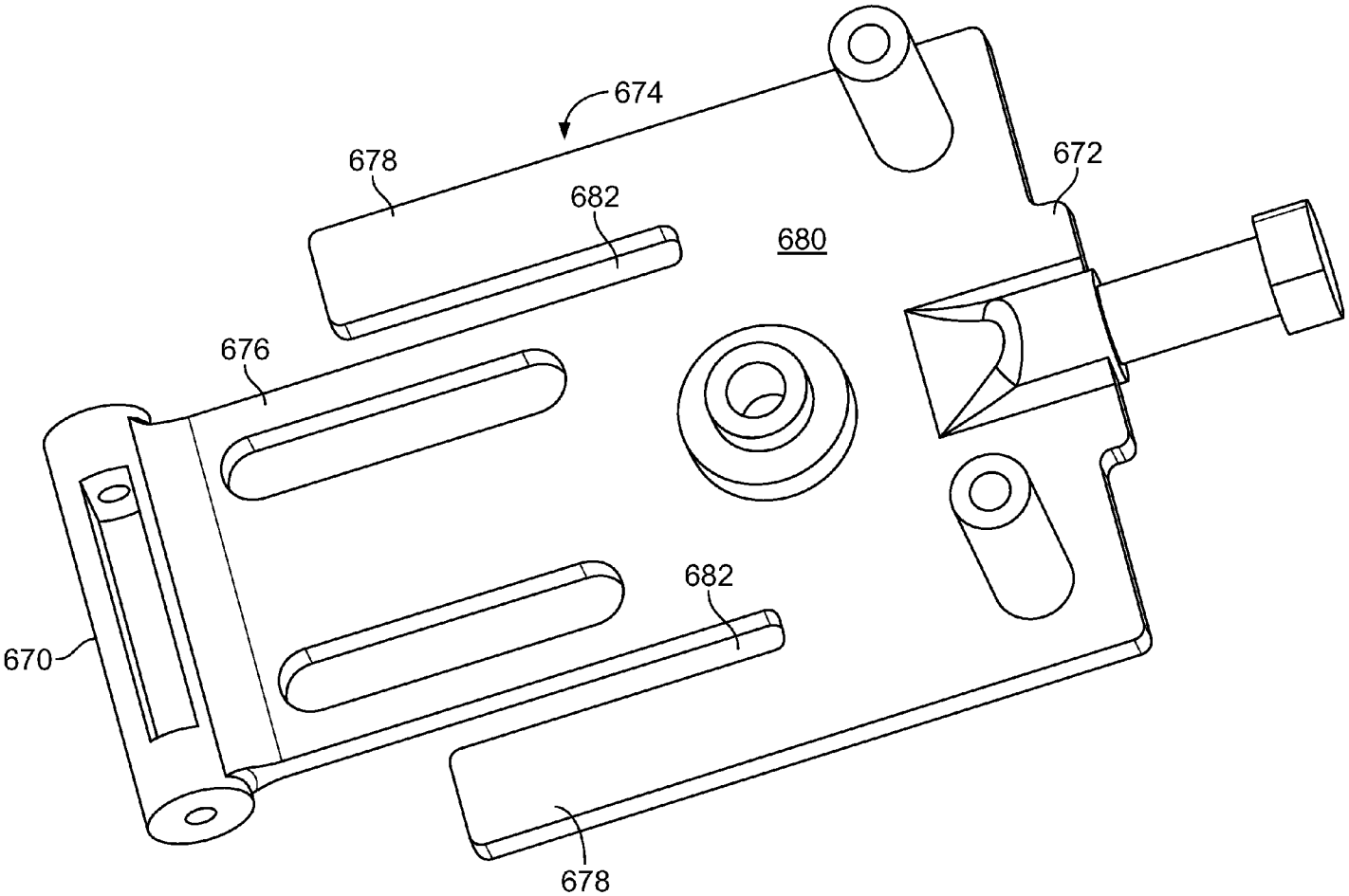
FIG. 13D is an enlarged view of the chassis from FIG. 13A.

Referring now to FIG. 13D, there is shown in one variation of this embodiment the chassis 610 having a rear portion 670 connected to a front portion 672 by a middle portion 674. The connection between the rear portion 670 to the middle portion 674 is such that the rear portion 670 may flex upwardly and downwardly and thus act as a rear suspension. The flexing is accomplished by having a narrowed rear connecting member 676 extending from the rear portion 670 towards the middle portion 674 and extending between elongated edge members 678 defined by the middle portion and then connecting the a central section 680 of the middle portion 674. A slight separation of gap 682 is formed between the rear connecting member 676 and the elongated edge members 678 to further aid in the flexibility of the rear portion 670.

The middle portion 674 includes narrowed rear connecting member 676 extends from the rear portion 670

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

We claim:

1. A toy car comprising:

a chassis having four wheels rotatably attached thereto and having a body secured to the chassis; and the four wheels have a first weight that is at least 40% of the total weight of the toy car, and wherein the chassis further includes:

a rear portion having a pair of oppositely facing openings, rear pin ends extending from the openings to connect a pair of rear wheels, defined from the four wheels, to the rear portion of the chassis; and a front portion being secured to a front end sway suspension system, the front end sway suspension system defined as haying:

a front suspension member comprising:

a center section having a back face secured to the front portion of the chassis, and two side faces, each side face having upper and lower legs extends out therefrom, each leg further includes a substantially horizontal flange extending therefrom with an opening defined on each flange such that the openings on each pair of upper and lower legs face towards each other;

a pair of casters, each caster having an opening sized to receive a front pin end to connect a front wheel, defined from the four wheels, thereto, each caster further has a peg positioned on a first side of the opening, the peg having upper and lower proiections sized to be received within the openings on the upper and lower legs, and each caster further has an upwardly extending rod positioned on a second side of the opening; and a sway bar being positioned over a portion of the front portion of the chassis, the sway bar having sway bar ends with apertures to receive the upwardly extending rods defined by the pair of casters.

2. A toy car comprising:

a chassis;

a body secured to an upper portion of the chassis; and four wheels, each wheel having a center point defined therein, the four wheels being rotatably attached to the chassis body separately at the center point of each wheel, and the four wheels have a combined first weight such that a horizontally planar center of gravity defined by the toy car and measured from a lowest point on an outer edge of the four wheels towards a center of the chassis body is positioned substantially about the center point of the four wheels, and wherein the chassis further includes:

a rear portion having a pair of oppositely facing openings, rear pin ends extending from the openings to connect a pair of rear wheels, defined from the four wheels, to the rear portion of the chassis; and a front portion being secured to a front end sway suspension system, the front end sway suspension system defined as having:

a front suspension member comprising:

a center section having a back face secured to the front portion of the chassis, and two side faces, each side face having upper and lower legs extends out therefrom, each leg further includes a substantially horizontal flange extending therefrom with an opening defined on each flange such that the openings on each pair of upper and lower legs face towards each other;

a pair of casters, each caster having an opening sized to receive a front pin end to connect a front wheel, defined from the four wheels, thereto, each caster further has a peg positioned on a first side of the opening, the peg having upper and lower proiections sized to be received within the openings on the upper and lower legs, and each caster further has an upwardly extending rod positioned on a second side of the opening; and a sway bar being positioned over a portion of the front portion of the chassis, the sway bar having sway bar ends with apertures to receive the upwardly extending rods defined by the pair of casters.

3. The toy car of claim 1, wherein each wheel has a center point defined therein and the four wheels have a combined first weight such that a horizontally planar center of gravity defined by the toy car and measured from a lowest point on an outer edge of the four wheels towards a center of the chassis body is positioned substantially about the center point of the four wheels.

4. The toy car of claim 1 or 2, wherein the body includes an upper outer portion and the upper outer portion includes a finger detent.

5. The toy car of claim 2, wherein the horizontally planar center of gravity is about 0.05 mm above the center point of the four wheels.

6. The toy car of claim 1 or 2, wherein each wheel is removably secured to the chassis and includes an out rim with a removably cover tire.

7. The toy car of claim 1 or 2, wherein the first weight of the four wheels is at least 80% of the total weight of the toy car.

8. The toy car of claim 1 or 2, wherein the first weight of the four wheels is at least 70% of the total weight of the toy car.

9. The toy car of claim 1 or 2, wherein the first weight of the four wheels is at least 50% of the total weight of the toy car.

10. The toy car of claim 2, wherein the first weight of the four wheels is at least 40% of the total weight of the toy car.

11. A toy car having a chassis with four wheels rotatably attached thereto and further having a body secured to the chassis; and wherein the chassis further includes:

a rear portion having a pair of oppositely facing openings, rear pin ends extending from the openings to connect a pair of rear wheels, defined from the four wheels, to the rear portion of the chassis; and a front portion being secured to a front end sway suspension system, the front end sway suspension system defined as having:

a front suspension member comprising:

a center section having a back face secured to the front portion of the chassis, and two side faces, each side face having upper and lower legs extends out therefrom, each leg further includes a substantially horizontal flange extending therefrom with an opening defined on each flange such that the openings on each pair of upper and lower legs face towards each other;

a pair of casters, each caster having an opening sized to receive a front pin end to connect a front wheel, defined from the four wheels, thereto, each caster further has a peg positioned on a first side of the opening, the peg having upper and lower projections sized to be received within the openings on the upper and lower legs, and each caster further has an upwardly extending rod positioned on a second side of the opening; and a sway bar being positioned over a portion of the front portion of the chassis, the sway bar having sway bar ends with apertures to receive the upwardly extending rods defined by the pair of casters.

12. The toy car of claim 11, wherein the peg has a length smaller then the distance between the upper and lower legs such that the peg freely rotates and is capable of moving in a vertical direction.

13. The toy car of claim 11, wherein the chassis further includes a main body portion positioned between the rear and front portions of the chassis, the main body portion includes at least one vertically facing member to receive and secure the body to the chassis.

14. The toy car of claim 11, wherein a distance between the opening and the peg is offset between substantially 1 to 4 mm.

15. The toy car of claim 11, wherein the rear portion of the chassis is flexibly connected to a middle portion defined by the chassis, and wherein the flexible connection between the rear portion and the middle portion is defined by providing a rear connecting member extending from the rear portion to connect to a central section of the middle portion, the middle portion further having an elongated edge member on either side of the middle portion that extend towards the rear portion on either side of the rear connecting member and which create gaps between the rear connecting member and the elongated edge members.

16. A toy car having a chassis with four wheels rotatably attached thereto and further having a body secured to the chassis; and wherein the chassis further includes:

a front and rear portion, the rear portion having a pair of oppositely facing openings, rear pin ends extending from the openings to connect a pair of rear wheels, defined from the four wheels, to the rear portion of the chassis;

a front end sway suspension system secured to the front portion, and the front end sway suspension system having:

a front suspension member comprising:

a center section having a back face secured to the front portion of the chassis, and two side faces, each side face having upper and lower legs extends out therefrom, each leg further includes a substantially horizontal flange extending therefrom with an opening defined on each flange such that the openings on each pair of upper and lower legs face towards each other;

a pair of casters, each caster having an opening sized to receive a front pin end to connect a front wheel, defined from the four wheels, thereto, each caster further has a peg positioned on a first side of the opening, the peg having a bore therethrough to align with the openings on the upper and lower legs and a peg pin sized to secure the bore to the openings on the upper and lower legs, and each caster further has an upwardly extending rod positioned adjacent to the opening;

a sway bar being positioned over a portion of the front portion of the chassis, the sway bar having sway bar ends secured to the upwardly extending rods defined by the pair of casters, the sway bar further includes a pair of guide posts separately extending from the sway bar ends towards the rear portion of the chassis, the sway bar further includes an inward notch defined at a junction of the guide post and the sway bar end; and a sliding locking mechanism having a sliding channel defined from a base member, a pair of side walls extending from the base member, and an inwardly turned lip defined along a terminating edge of the side walls, the sliding channel sized to slide along a portion of the chassis body between the front and rear portions of the chassis, a pair of locking posts extending upwardly from a portion of the sliding locking mechanism, and wherein when the sliding locking mechanism is moved towards the sway bar the locking posts are positionable in the notches to restrict movement of the sway bar and therefore restrict movement of wheels connected to the front portion of the chassis.

* * * * *